United States Patent [19]

Kazusa et al.

[11] Patent Number: 4,746,839

[45] Date of Patent: May 24, 1988

[54] SIDE-COUPLED STANDING-WAVE LINEAR ACCELERATOR

[75] Inventors: Chudo Kazusa; Masaharu Yoneda, both of Tokyo, Japan

[73] Assignee: NEC Corporation, Tokyo, Japan

[21] Appl. No.: 874,846

[22] Filed: Jun. 16, 1986

[30] Foreign Application Priority Data

Jun. 14, 1985 [JP] Japan ..... 60-129671

[51] Int. Cl.[4] ..... H01J 25/00

[52] U.S. Cl. ..... 315/5.41; 315/5.42; 315/5.43; 315/5.46; 315/5.47

[58] Field of Search ..... 315/5.41, 5.42, 5.43, 315/5.46, 5.47, 3.5

[56] References Cited

U.S. PATENT DOCUMENTS 4,122,373 10/1978 Vaguine ..... 315/5.41
4,146,817 3/1979 McEuen et al. ..... 315/5.41
4,150,322 4/1979 Tran et al. ..... 315/5.41
4,286,192 8/1981 Tanabe et al. .
4,382,208 5/1983 Meddaugh et al. .
4,400,650 8/1983 Giebeler, Jr. ..... 315/5.41
4,629,938 12/1986 Whitman ..... 315/5.42

*Primary Examiner*—David K. Moore
*Assistant Examiner*—Michael J. Nickerson
*Attorney, Agent, or Firm*—Foley & Lardner, Schwartz, Jeffery, Schwaab, Mack, Blumenthal & Evans

[57] ABSTRACT

A side-coupled standing-wave linear accelerator for accelerating a particle beam, includes a cascade of accelerating resonant cavities linearly located along the axis of the particle beam and coupled in series through drift tubes allowing passage of the particle beam. Each pair of adjacent accelerating resonant cavities is electromagnetically coupled by a side-coupling cavity. At least one side-coupling cavity is a non-resonant type switchable between a first position of electromagnetically coupling a given pair of adjacent accelerating cavities and a second position of electromagnetically decoupling the same given pair of accelerating cavities.

4 Claims, 5 Drawing Sheets

$$\frac{E_2}{E_0} \doteqdot -\frac{K_{01}}{K_{12}}$$

$$\frac{E_2}{E_0} \doteqdot -\frac{K_{1,9}}{K_{9,2}}$$

or $$\frac{E_2}{E_0} \doteqdot -\frac{K_{1,10}}{K_{10,2}}$$

SIDE-COUPLED STANDING-WAVE LINEAR ACCELERATOR

BACKGROUND OF THE INVENTION

1. Field of the Invention

The present invention relates to a side-coupled standing-wave linear accelerator including a cascade of accelerating cavities linearly arranged along the axis of an energy beam and electromagnetically coupled by side cavities. More particularly, the present invention relates to such an acceleration of the variable-energy type including a non-resonant coupling side cavity switchable to electromagnetically couple and decouple a given pair of adjacent accelerating cavities so that the energy of a beam is discretely adjusted over a wide range while keeping a narrow spread of energy.

2. Descripiton of related art

So-called side-coupled standing-wave linear accelerators are used in association with X-ray tubes so that an accelerated electron beam is impinged on an X-ray radiation target. In such an X-ray generation, the following variable parameters of the standing-wave linear accelerator have generally been varied to control the energy of X-rays: an accelerating voltage of an electron beam, an input rf power, and an accelerating electron beam current.

Recently, another approach to energy control has been developed, which is to vary continuously the resonant mode patterns of the side coupling cavities, while keeping the constant resonance frequency. Such approaches are disclosed in U.S. Pat. No. 4,286,192 to Eiji Tanabe et al and U.S. Pat. No. 4,382,208 to Gard Meddaugh et al.

FIG. 1 is a schematic cross sectional view showing a pair of accelerating cavities 1 of a conventional side-coupled standing wave linear accelerator. The pair of accelerating cavities 1 are coupled by a drift tube 2 which allows passage of a beam of charged particles such an electrons, and also electromagnetically coupled by a "side" or "coupling" cavity 3, which is electromagnetically connected to each of the accelerating cavities 1 through an iris 4.

FIG. 2 is an equivalent circuit of the structure shown in FIG. 1. The left-hand cavity 1 is compared to a closed circuit composed of a capacitance $C_O$, an inductance $L_O$ and a resistance $R_O$ in series. The equivalent circuit of the right-hand cavity 1 includes a capacitance $C_2$, an inductance $L_2$ and a resistance $R_2$ connected in series. The equivalent circuit of coupling side cavity 3 includes a capacitance $C_1$, an inductance $L_1$, a resistance $R_1$ and another inductance $L_1$ all connected in series. One of the inductances $L_1$ is coupled to the inductance $L_O$ with the coupling constant $k_{01}$ and the other inductance $L_1$ is coupled to the inductance $L_2$ with the coupling constant $k_{12}$.

If we designate the amplitude of the accelerating electric field of the left-hand accelerating cavity 1 as $E_0$ and that of the right-hand one as $E_2$, the ratio of the latter to the former is determined by the ratio of the electromagnetic coupling factor $k_{01}$ between the left-hand accelerating cavity 1 and the coupling side cavity 3 to the electromagnetic coupling factor $k_{12}$ between the right-hand accelerating cavity 1 and the coupling side cavity 4: $E_2/E_0 = -k_{01}/k_{12}$. Therefore, by varying the electromagnetic coupling ratio, the ratio of accelerating electric fields between adjacent accelerating cavities can be modified. The same effect can be obtained by introducing a difference of phase between coupled electromagnetic energies without varying the electromagnetic coupling ratio.

For this purpose, in the prior art, the difference in strength of accelerating electric field between the adjacent accelerating cavities has been adjusted or varied by changing the resonant mode of the coupling side cavity 3. The imporant matter is, in this case, to vary the degree of coupling while keeping the constant resonance frequency of the coupling side cavity 3.

The approaches just mentioned above, however, have the following drawbacks:

1. In the case of varying the accelerating voltage of the electron beam, the change of the voltage will cause the value of electron bunching to be inevitably separated from the optimum designated value of electron bunching, with the result that the spectrum of energy will spread.

2. In case of varying the input rf power or accelerating electron beam current, the energy spread increases as the modified value differs more from the initially optimized one, just as in the case above.

3. Energy spread as explained for the cases 1 and 2 leads not only to deterioration of output stability and reproducibility, but also to decrease in the current of the accelerated particles. As a consequence, the dosage rate by X-rays produced will decrease.

4. In case of continuously varying the degree of electromagnetic coupling or the phase difference between the accelerating cavities by changing continuously the resonance mode with a fixed resonance frequency, high precision is required for the manufacture and adjustment of a mechanical modulator used as a means of modifying the degree of coupling or the phase difference. In order to keep a constant resonant frequency and in order to make variable the degree of coupling, the position control with high precision of not greater than 0.2 mm and its high reproducibility are necessary. Such a modulator is difficult to fabricate, and furthermore, the reproducibility and stability fulfilling such a requirement cannot be obtained because of thermal change.

SUMMARY OF THE INVENTION

Accordingly, it is an object of the present invention to provide a variable-energy side-coupled standing-wave linear accelerator being free of the drawbacks mentioned above.

Another object of the present invention is to provide a variable-energy side-coupled standing-wave linear accelerator having excellent reproducibility and stability in connection with changes or adjustments of the coupling degree in the coupling side cavities.

Still another object of the present invention is to provide a variable-energy side-coupled standing-wave linear accelerator having a coupling side cavity which does not need high mechanical precision in manufacture and adjusting operation, as compared to the conventional ones.

A further object of the present invention is to provide a variable-energy side-coupled standing-wave linear accelerator having a coupling side cavity which can make or break the coupling between a pair of adjacent accelerating cavities, so that it is free from high precise adjustment.

The above and other objects are achieved in accordance with the present invention by a side-coupled standing-wave linear accelerator for accelerating a particle beam, which includes a cascade of accelerating resonant cavities linearly located along the axis of the particle beam and coupled in series through drift tubes allowing passage of the particle beam, each pair of adjacent accelerating resonant cavities being electromagnetically coupled by a side-coupling cavity, wherein the improvement comprises at least one side-coupling cavity which is of a non-resonant type switchable between a first position of electromagnetically coupling a given pair of adjacent accelerating cavities and a second position of electromagnetically decoupling the same given pair of accelerating cavities.

With the above arrangement of the linear accelerator, the electric field distribution in the accelerator can be discretely changed by selectively putting the non-resonant side-coupling cavity in either the first or second positions. Namely, when the non-resonant side-coupling cavity is in the first position, the electric field appears in each of the accelerating cavities. On the other hand, when the non-resonant side-coupling cavity is in the second position, the electromagnetic coupling among all the accelerating cavities is interrupted by the non-resonant side-coupling cavity, so that no electric field appears in a accelerating cavity or cavities downstream or upstream of the non-resonant side-coupling cavity. Thus, the accelerating energy for the charged particle beam can be changed to two discrete modes.

In one preferred embodiment, the non-resonant side-coupling cavity includes a pair of first and second non-resonant side-coupling cavities which electromagnetically couple the same give pair of accelerating cavities. The first cavity is coupled to one cavity of the given pair of accelerating cavities with a first coupling coefficient and to the other cavity of the given pair of accelerating cavities with a second coupling coefficient larger than the first coefficient. The second cavity is coupled to the one cavity of the given pair of accelerating cavities with a third coupling coefficient and to the other cavity of the given pair of accelerating cavities with a fourth coupling coefficient smaller than the third coefficient. With this arrangement, the degree of coupling between the given pair of accelerating cavities can be discretely changed at four stages by selectively putting the first and second non-resonant side-coupling cavities into the first and second positions.

Thus, the accelerating energy for the charged particle beam can be changed to a number of discrete levels by selecting the number of accelerating cavities, the number of non-resonant side-coupling cavities and the coupling degrees between the respective non-resonant side-coupling cavities and the associated accelerating cavities.

The above and other objects, features and advantages of the present invention will be apparent from the following description of preferred embodiments of the invention with reference to the accompanying drawings.

DETAILED DESCRIPTION OF THE PREFERRED EMBODIMENTS

Figure 1:
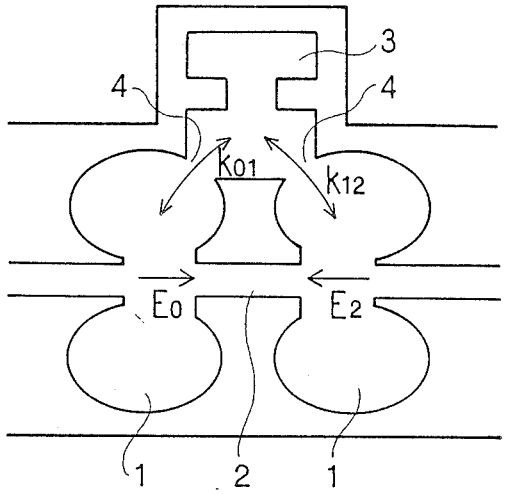
FIGURE 1 PRIOR ART
FIG. 1 is a partial schematic cross sectional view showing a side-coupled standing-wave linear accelerator of the prior art.
Figure 2:
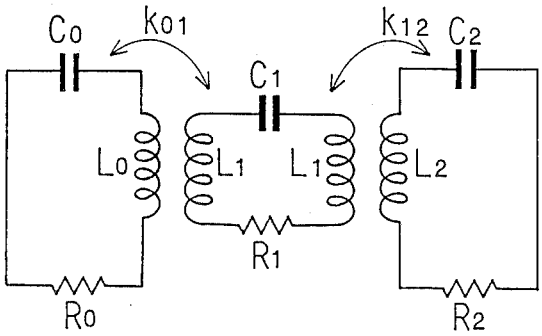
FIGURE 2 PRIOR ART
FIG. 2 is an equivalent circuit of the acelerator portion of FIG. 1.
Figure 3:
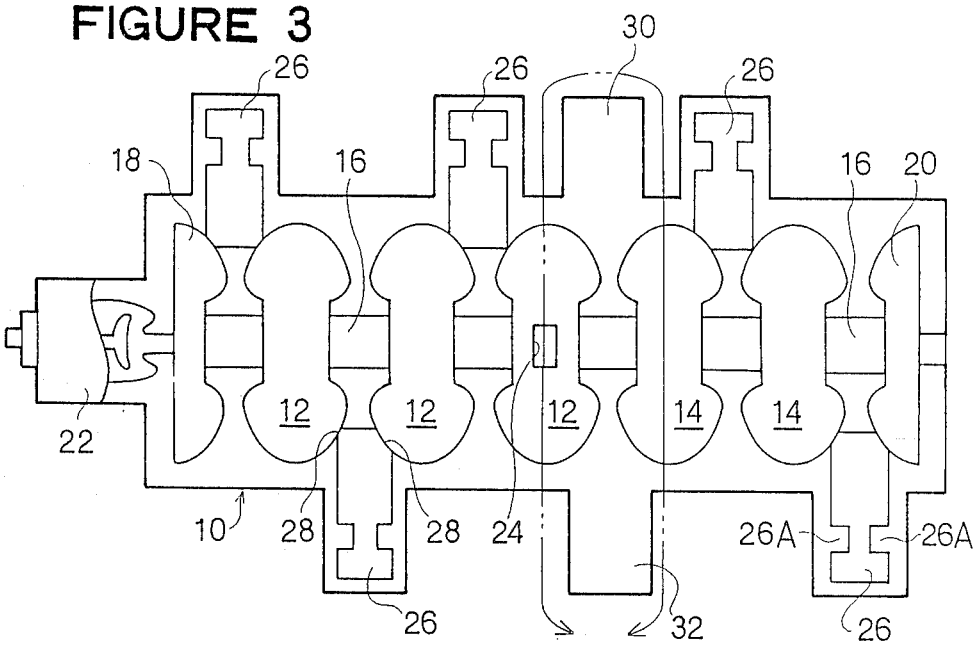
FIG. 3 is a schematic cross sectional view showing a side-coupled standing-wave linear accelerator embodying the present invention.

FIG. 3 is a schematic cross sectional view of a side-coupled standing-wave linear accelerator embodying the present invention. The accelerator includes an accelerating section 10 having a plurality of successively and linearly arranged doughnut-shaped cavity resonators 12 and 14 coupled by a drift tube 16 where an accelerated particle beam passes through. The outermost terminal one of the cavities 14 is an inlet cavity 18 which is one half of the other cavities 12, and the outermost terminal one of the cavities 14 is an outlet cavity 20 which is one half of the other cavities 14. A source of a particle beam 22 such as an electron gun is disposed at the upstream end of the accelerating section. The beam produced at the source 22 is first injected into the inlet cavity 18, passed through the drift tubes 16 and the cavity resonators 12 and 14, and then emitted from the outlet cavity 20.

The accelerating section is excited with microwave energy introduced from an inlet port 24 provided in one of the cavities 12 and 14 and connected to a microwave energy source not shown connected by means of a waveguide (not shown).

A plurality of side-coupling cavities 26 are disposed off the axis of the accelerating section alternately up and down for electromagnetically coupling each pair of adjacent accelerating cavities 12 and 14. Each of the side-coupling cavities 26 is for example of cylindrical shape and has a pair of inwardly projecting capacitive load members 26A disposed at the center. The load members 26A project into the cylindrical cavity from opposite end walls. Each side-coupling cavity 26 is disposed such that it is approximately tangent to the accelerating cavities 12 and 14 with the corner of each side coupling cavity 26 intersecting the inside walls of the accelerating cavities 12 and 14 to define the magnetic field coupling irises 28. Through the irises 28, the electromagnetic wave energy is coupled between the accelerating cavities 12 and 14 and the associated coupling cavities 26. The accelerating cavities 12 and 14 and the coupling cavities 26 are all tuned to essentially the same frequency.

Furthermore, a pair of non-resonant electromagnetic energy coupling side cavities 30 and 32 are disposed off the axis of the accelerating section instead of a side-coupling cavity 26. The two non-resonant side-coupling cavities 30 and 32 have an opposite directivity in electromagnetically coupling between a pair of adjacent accelerating cavities 12 and 14.

Figure 4:
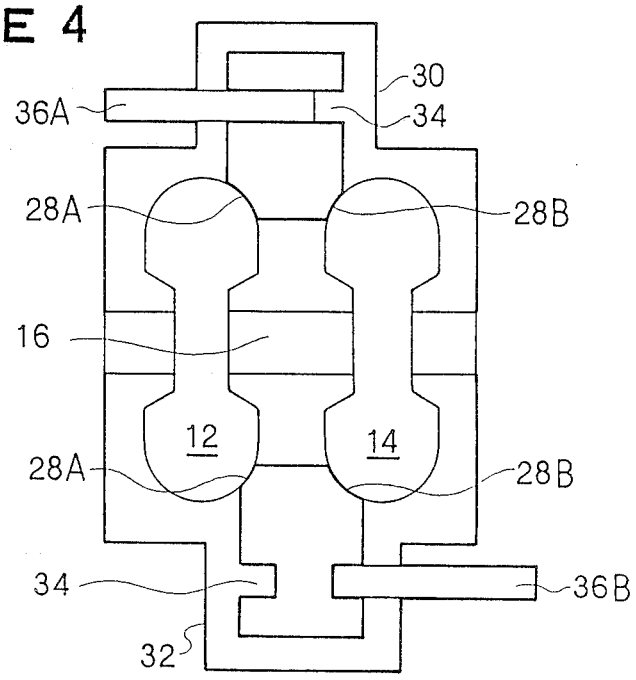
FIG. 4 is a detailed cross-sectional view of an energy switching portion of FIG. 3.

FIG. 4 is a detailed cross sectional view of the electromagnetic energy coupling switching cavities 30 and 32. Each of the non-resonant side-coupling cavities 30 and 32 includes a cylindrical side wall and a projecting capacitive load member 34 fixed at the center. Facing the load member 34 is a switch plunger 36A (or 36B) which can be axially moved to vary the degree of electromagnetic coupling.

In FIG. 4, the plunger 36A is in contact with the opposite member 34 in the upper non-resonant side-coupling cavity 30, while the plunger 36B is separated from the opposite member 34 in the lower non-resonant side-coupling cavity 32.

In addition, the sizes of the irises 28A and 28B of each non-resonant cavity, that is, the degrees of coupling between the accelerating cavities 12 and 14 and the non-resonant side-coupling cavities 30 and 32 are different. For example, in FIG. 4, in the non-resonant side-coupling cavity 30, the left-hand iris 28A is larger than the right-hand one 28B; in the non-resonant side-coupling cavity 32, the left-hand iris 28A is smaller than the right-hand one 28B.

Figure 5:
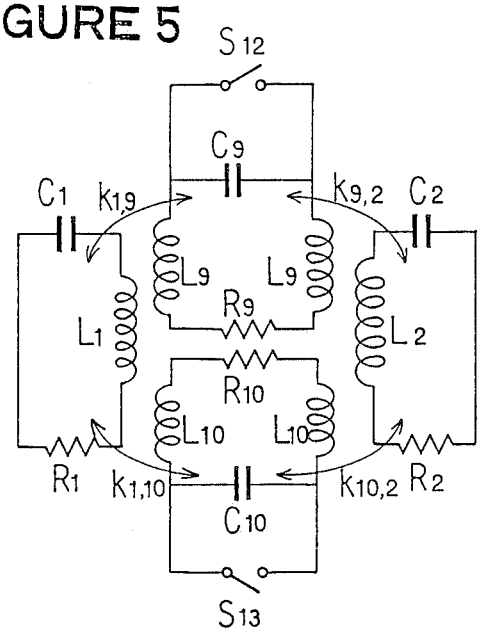
FIG. 5 is an equivalent circuit of the switching portion shown in FIG. 4.

FIG. 5 is an equivalent circuit of the cavities 30 and 32 of FIG. 4. Left-hand accelerating cavity 12 is equivalent to a circuit composed of a capacitance $C_1$, an inductance $L_1$ and a resistance $R_1$ connected in series. Right-hand accelerating cavity 14 is compared equivalent to a circuit composed of a capacitance $C_2$, an inductance $L_2$ and a resistance $R_2$ connected in series. Upper non-resonant side-coupling cavity 30 is equivalent to a circuit composed of a capacitance $C_9$, an inductance $L_9$, a resistance $R_9$, another inductance $L_9$ connected in a series and switch $S_{12}$ connected in parallel to the capacitance $C_9$. Lower non-resonant side-coupling cavity 32 is equivalent to a circuit composed of a capacitance $C_{10}$, an inductance $L_{10}$, a resistance $R_{10}$, another inductance $L_{10}$ connected in series and a switch $S_{13}$ connected in parallel to the capacitance $C_{10}$. One of the inductances $L_9$ is coupled to the inductance $L_1$ with the coupling constant $K_{1,9}$. The other inductance $L_9$ is coupled to the inductance $L_2$ with the coupling constant $k_{9,2}$. One of the inductances $L_{10}$ is coupled to the inductance $L_1$ with the coupling constant $k_{1,10}$. The other inductance $L_{10}$ is coupled to the inductance $L_2$ with the coupling constant $k_{10,2}$.

Referring to FIG. 4 and 5, the operation of the accelerator of the invention will be explained.

The ratio of the amplitude of the accelerating electric field $E_0$ in the left-hand accelerating cavity 12 to the amplitude of the accelerating electric field $E_2$ in the right-hand accelerating cavity 14 can be varied by changing the degree of electromagnetic coupling between the accelerating cavities 12 and 14 and the associated non-resonant side-coupling cavities 30 and 32, on the basis of the same principle as has been done for the accelerator of the prior art. However, the method of changing the degree of coupling is different: in the prior art the change of electromagnetic coupling was executed by changing the resonant mode; in the present invention, the ratio between the sizes of the irises 28A and 28B determines the degree of coupling. As a result, the degree of coupling has several predetermined discrete values in contrast to the continuous change of the degree of coupling in the prior art.

The above mentioned difference of the sizes of the irises 28A and 28B leads to the difference of coupling factor $k_{i,j}$ of of the circuit of FIG. 5. Because the left-side iris 28A is larger than the right-side iris 28B in the non-resonant cavity 30, the following relation can be obtaianed: $k_{1,9} > k_{9,2}$. In the same way, the relation $k_{1,10} > k_{10,2}$ is obtained. As an example, if we put $k_{1,9}/k_{9,2}=2$, then we get $E_2/E_0=2$. Also, if we put $k_{1,10}/k_{10,2}=\frac{1}{2}$, then we get $E_2/E_0=\frac{1}{2}$. Each of the non-resonant side-coupling cavities 30 and 32 is adjusted to a characteristic resonant frequency with the plunger 38 being open. The resonant frequency is the same as that in the other side-coupling cavities 26.

In order to obtain the relation $E_2/E_0=\frac{1}{2}$, the plunger 36A of the upper cavity 30 is shut or is placed in contact with the associated projecting member 34, and the plunger 36B of the lower cavity 32 is open or is separated from the associated projecting member 34. With such a disposition of the plungers 36A and 36B, the side-coupling cavity 30 becomes non-resonant and the electromagnetic energy coupling path is formed between the accelerating cavities 12 and 14 through only the cavity 32.

On the contrary, in order to obtain $E_2/E_0=2$, we must open the plunger 36A and shut the plunger 36B. Then, the side-coupling cavity 32 becomes non-resonant and the electromagnetic energy coupling path is formed between the accelerating cavities 12 and 14 through only the cavity 30.

Because of the functions mentioned above, the cavities 30 and 32 can be called a non-resonant type electromagnetic energy coupling switching side-coupling cavity.

In other cases where the plungers 12, 13 are both shut or both open, the ratio $E_2/E_0$ can have different values. When both of the plungers 12, 13 are open, the irises 36A and 36B are effective in parallel and the ratio $E_2/E_0$ becomes $\sqrt{k_{1,9} \cdot k_{1,10}/k_{9,2} \cdot k_{10,2}}$. Then, the cavities 30 and 32 have the resonant frequency different from the adjusted resonance frequency. When both of the plungers 12, 13 are shut, both of the cavities 30 and 32 become non-resonant and the relation $E_2/E_0$ is 0.

FIGS. 6A to 6D represent the four states of the plungers 36A and 36B mentioned above. Distribution of electric field along the beam axis corresponding to the four states are also shown in FIGS. 7A to 7B.

Figure 6A:
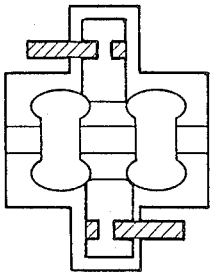
FIGS. 6A to 6D show several conditions of the switching portion shown in FIG. 4.
Figure 7A:
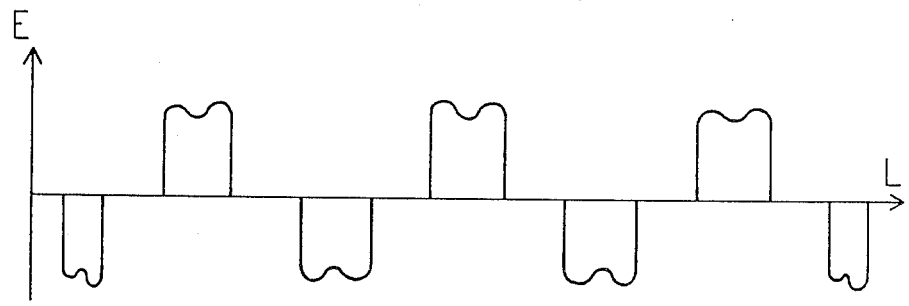
FIGS. 7A to 7D are sketches showing the respective electric field distribution of the accelerator when the switching portion is put in the conditions shown in FIGS. 6A to 6D, respectively.
Figure 7B:
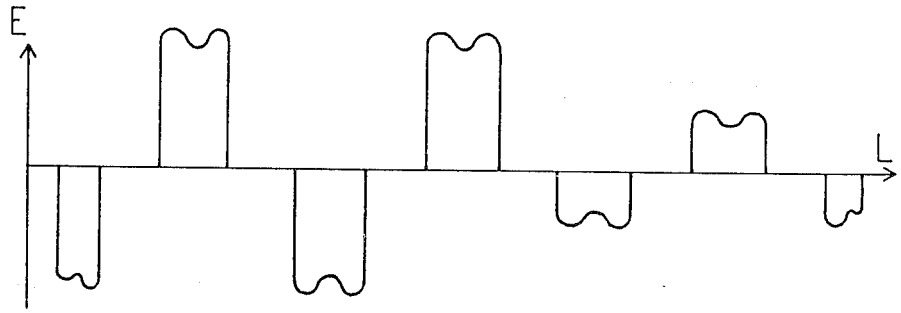

FIG. 6A represents a state where the plungers 36A and 36B are both open. The magnitudes of electric field of the respective accelerating cavities are the same along the whole axis as shown in FIG. 7A, but the polarity of the electric fields are alternately changed. The spacing between accelerating cavities 12 and 14 are about one-half of a free-space wavelength of the accelerating microwave. Thus, the acceleration section 10 is excited in a standing-wave resonance with $\pi/2$ radians phase shift between each coupling or accelerating cavity and the adjacent downstream cavity. Therefore, the complete periodic resonant structure operates in a mode with $\pi/2$ phase shift per cavity.

Figure 6C:
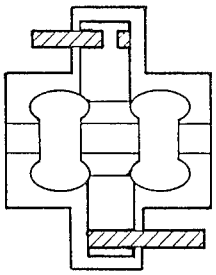
Figure 6B:
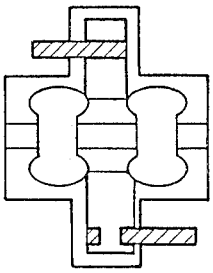

FIG. 6B shows a state where the plunger 36A is shut and the plunger 36B is open. With this disposition of the plungers, the ratio $E_2/E_0$ becomes $\frac{1}{2}$. Therefore, the electric field at the left cavities 12 is two times stronger than that at the right cavities 14 as shown in FIG. 7B.

Figure 7C:
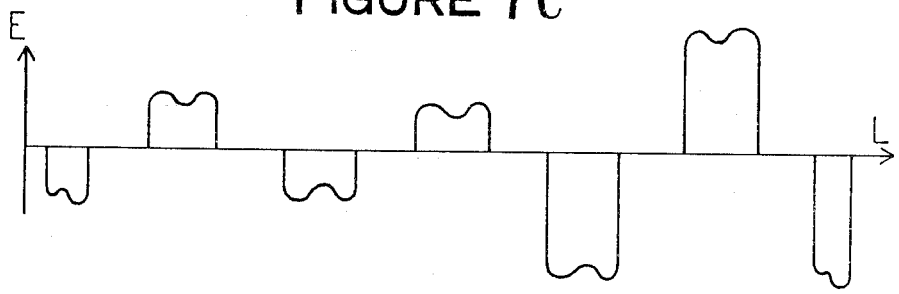

FIG. 6C shows a state where the plunger 36A is open and the plunger 36B is shut. With this disposition of the plungers, the ratio $E_2/E_0$ becomes 2. Therefore, the electric field at the right cavities 14 is two times stronger than that at the left cavities 12 as shown in FIG. 7C.

Figure 6D:
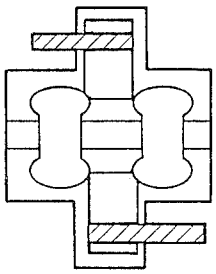
Figure 7D:
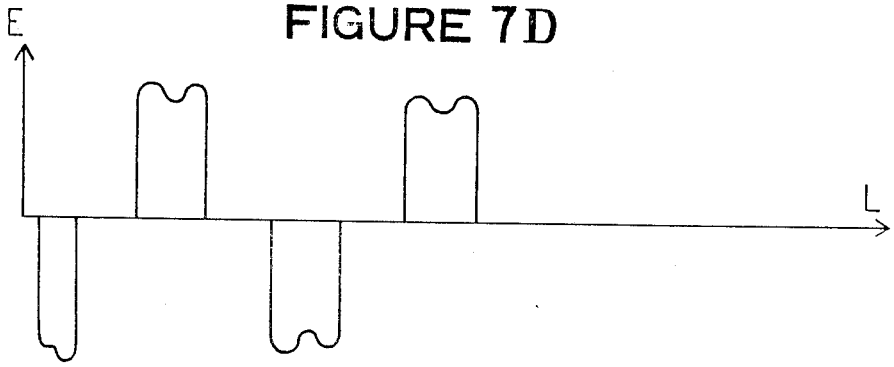

FIG. 6D represents a state where the plungers 36A and 36B are both shut. Then, no energy transfer path to the right cavities 14 is formed. Therefore, no electric field appears in the right cavities 14 as shown in FIG. 7D.

By choosing the state of plungers 36A and 36B of the side-coupling cavities 30 and 32 the accelerating electric field, i.e. the accelerating energy of particles, can be discretely changed in magnitude.

Switching of the plungers 36A and 36B is realized electrically or mechanically using a conventional method.

Figure 8:
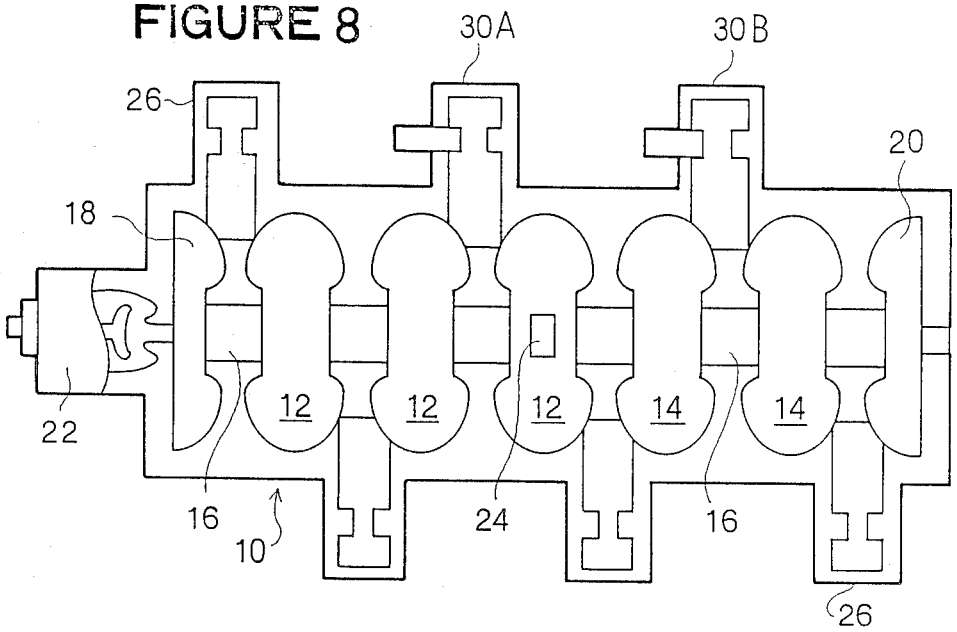
FIGS. 8 and 9 are schematic cross sectional views of second and third embodiments of the accelerator in accordance with the present invention.

FIGS. 8 shows another embodiment of the accelerator in accordance with the present invention, in which the portions similar to those shown in FIG. 3 are given the same reference numerals. As will be seen from comparison between FIGS. 3 and 8, the second embodiment has two non-resonant side-coupling cavities 30A and 30B similar to the cavity 30 shown in FIG. 4. One of the side-coupling cavities 30A is provides electromagnetic coupling between the accelerating cavity 12 provided with the microwave introducing port 24 and an upstream adjacent cavity. The other side-coupling cavity 30B electromagnetically couples a pair of accelerating cavities 14 downstream of the accelerating cavity 12 provided with the microwave introducing port 24. In this embodiment, the electric field distribution in the accelerating section 10 can take on four different states.

Figure 9:
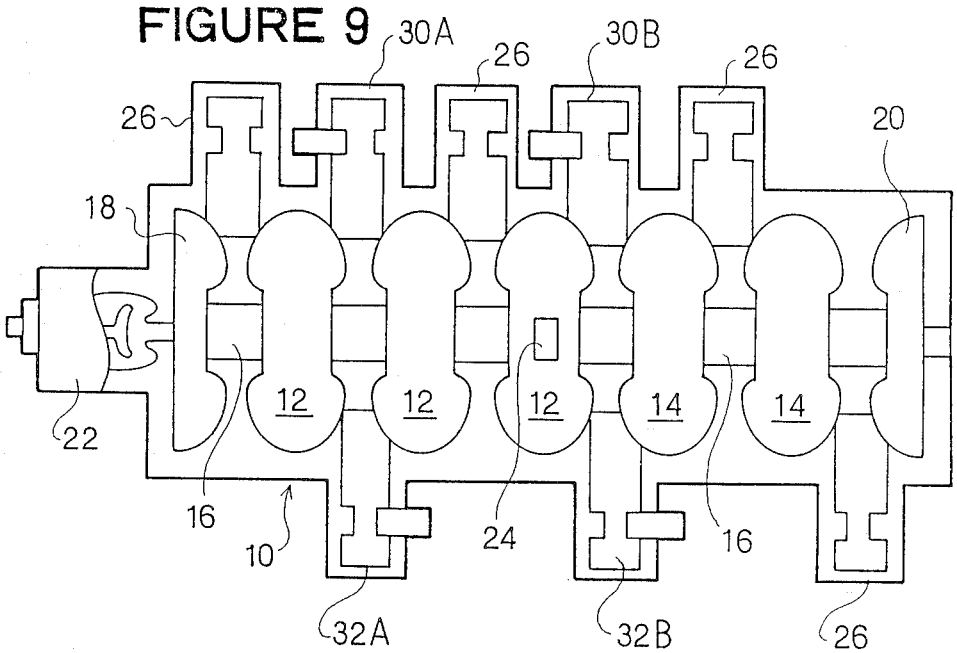

FIG. 9 shows a third embodiment of the accelerator in accordance with the present invention, in which the portions similar to those shown in FIG. 3 are given the same reference numerals. As will be seen from comparison between FIGS. 3 and 9, the third embodiment includes two pair of side-coupling cavities 30A and 32A and 30B and 32B similar to the pair of cavities 30 and 32 shown in FIG. 4. The first pair of side-coupling cavities 30A and 32A are provided to electromagnetically couple a pair of accelerating cavities 12 upstream of the accelerating cavity 12 provided with the microwave introducing port 24. The second pair of cavities 30B and 32B electromagnetically couple the accelerating cavity 12 provided with the microwave introducing port 24 and a downstream adjacent cavity 14. In this embodiment, the electric field distribution in the accelerating section 10 can be discretely adjusted at sixteen stages.

As seen from the above, the accelerator in accordance with the present invention includes at least one non-resonant side-coupling cavity which is adapted to be switchable between a first position of electromagnetically coupling a given pair of accelerating cavities and a second position of electromagnetically decoupling the given pair of accelerating cavities. Therefore, the energy of the charged particle beam can be discretely adjusted over a wide range keeping a narrow energy spectrum spread.

The invention has thus been shown and described with reference to specific embodiments. However, it should be noted that the invention is in no way limited to the details of the illustrated structures but changes and modifications may be made within the scope of the appended claims.

We claim:

1. A side-coupled standing-wave linear accelerator for accelerating a particle beam comprising:

a cascade of accelerating resonant cavities linearly located along the axis of the particle beam, and coupled in series through drift tubes coupling together said accelerating resonant cavities in series for allowing passage of the particle beam therethrough, a side-coupling cavity electromagnetically coupling together each pair of adjacent accelerating resonant cavities, at least a pair of first and second bistable side-coupling cavities which electromagnetically couple one pair of adjacent acclerating resonant cavities, said first bistable side-coupling cavity being coupled to an upstream cavity of said one pair of adjacent accelerating resonant cavities, upstream relative to the direction of said particle beam, a first coupling iris coupling said first bistable side-coupling cavity to said upstream cavity, said first coupling iris of a size corresponding to a first coupling coefficient, said first bistable side-coupling cavity being coupled to a downstream cavity of said one pair of adjacent accelerating resonant cavities, downstream relative to said particle beam direction, a second coupling iris coupling said first bistable side-coupling cavity to said downstream cavity said second coupling iris of a size corresponding to a second coupling coefficient larger than said first coefficient, said second bistable side-coupling cavity coupled to said upstream cavity through a third coupling iris of a size corresponding to a third coupling coefficient and to said downstream cavity through a fourth coupling iris of a size corresponding to a fourth coupling coefficient smaller than said third coefficient, each of said first and second bistable side-coupling cavities having means being switchable between a first state of electromagnetically coupling said one pair of adjacent accelerating cavities and a second state of electromagnetically decoupling said one pair of adjacent accelerating cavities, whereby the degree of coupling between said one pair of adjacent accelerating cavities can be discretely changed by selectively switching said first and second bistable side-couple cavities into anyone of the first and second states.

2. An accelerator claimed in claim 1 wherein said means for each of said first and second bistable side-coupling cavities has a corresponding fixed member inwardly projecting into its cavity and a slidabley projecting plunger, said plunger operable in a first position, separated from the fixed member, to place said corresponding first or second bistable side-coupling cavity in said first state and in a second position, in contact with said fixed member to place said corresponding first or second bistable side-coupling cavity in said second state.

3. A side-coupled standing-wave linear accelerator for accelerating a particle beam comprising:

a cascade of accelerating resonant cavities linearly located along the axis of the particle beam, and coupled in series through drift tubes coupling together said accelerating resonant cavities in series for allowing passage of the particle beam therethrough, a side-coupling cavity electromagnetically coupling together each pair of adjacent accelerating resonant cavities, at least two pair of adjacent accelerating resonant cavities being electromagnetically coupled by associated bistable side-coupling cavity means which are switchable between a first state of electromagnetically coupling the associated pair of adjacent accelerating cavities and a second state of electromagnetically decoupling the associated pair of accelerating cavities, each of said bistable side-coupling cavity means including:

first and second bistable side-coupling cavities which electromagnetically couple said associated pair of adjacent accelerating cavities, said first bistable cavity being coupled to an upstream cavity of said associated pair of adjacent accelerating cavities in the direction of said particle beam through a first coupling iris of a size corresponding to a first coupling coefficient and to a downstream cavity of said associated pair of adjacent accelerating cavities through a second coupling iris of a size corresponding to a second coupling coefficient larger than said first coupling coefficient, and said second cavity being coupled to said upstream cavity of said associated pair of adjacent accelerating cavities through a third coupling iris of a size corresponding to a third coupling coefficient and to said downstream cavity of said associated pair of adjacent accelerating cavities through a fourth coupling iris of a size corresponding to a fourth coupling coefficient smaller than said third coefficient, each of said first and second bistable side-coupling cavities having means being switchable between a first state of electromagnetically coupling said associated pair of adjacent accelerating cavities and a second stat of electromagnetically decoupling said associated pair of adjacent accelerating cavities, whereby the degree of coupling between said associated pair of adjacent accelerating cavities can be discretely changed by selectively switching the first and second bistable side-coupling cavities into anyone of the first and second states.

4. An accelerator claimed in claim 3 wherein said means for each of said first and second bistable side-coupling cavities has a corresponding fixed member inwardly projecting into its cavity and a slidabley projecting plunger, said plunger operable in a first position, separated from the fixed member, to place said corresponding first or second bistable side-coupling cavity in said first state and in a second position, in contact with said fixed member to place said corresponding first or second bistable side-coupling cavity in said second state.

* * * * *